US007883062B2

(12) United States Patent
Zima

(10) Patent No.: US 7,883,062 B2
(45) Date of Patent: Feb. 8, 2011

(54) PORTABLE FOLDABLE MULTI-PURPOSE FLEXIBLE BAG HOLDER

(76) Inventor: Tracy J Zima, W10801 Highway 64, Antigo, WI (US) 54409

( * ) Notice: Subject to any disclaimer, the term of this patent is extended or adjusted under 35 U.S.C. 154(b) by 50 days.

(21) Appl. No.: 12/173,762

(22) Filed: Jul. 15, 2008

(65) Prior Publication Data

US 2009/0014603 A1 Jan. 15, 2009

Related U.S. Application Data

(63) Continuation-in-part of application No. 11/827,874, filed on Jul. 13, 2007, now abandoned.

(51) Int. Cl.
*B65B 55/00* (2006.01)

(52) U.S. Cl. ..... 248/99; 248/230.8

(58) Field of Classification Search ..... 248/95, 248/97, 99, 230.8, 101
See application file for complete search history.

(56) References Cited

U.S. PATENT DOCUMENTS

| | | | |
|---|---|---|---|
| 1,278,385 | A | 9/1918 | Richard |
| 1,351,094 | A | 8/1920 | Buckel |
| 1,647,679 | A | 11/1927 | Williams |
| 2,073,914 | A | 3/1937 | Wilfley |
| 3,180,384 | A | 4/1965 | Seifert |
| 3,583,748 | A | 6/1971 | Arndt |
| 3,692,072 | A | 9/1972 | Kohls |
| 4,287,701 | A | 9/1981 | Washington |
| 4,312,489 | A | 1/1982 | Paetzold |
| 4,488,697 | A | 12/1984 | Garvey |
| 4,610,039 | A | 9/1986 | Stern |
| 4,867,401 | A | 9/1989 | Graff |
| 4,899,967 | A | 2/1990 | Johnson |
| 4,919,546 | A | 4/1990 | Imazeki et al. |
| 4,940,201 | A | 7/1990 | Kurth |
| 4,951,903 | A | 8/1990 | Frey |
| 4,998,694 | A | 3/1991 | Barteaux |
| 5,092,548 | A | 3/1992 | Bayes et al. |
| 5,183,227 | A | 2/1993 | Wilhite |
| 5,213,141 | A | 5/1993 | Dorman |
| 5,393,023 | A | 2/1995 | Callan |
| 5,456,431 | A | 10/1995 | Ilinski |
| 5,570,862 | A | 11/1996 | Nugent |
| 5,593,117 | A | 1/1997 | Alexander, III |
| 5,597,022 | A | 1/1997 | Reifers |
| 5,738,315 | A | 4/1998 | Kent, Jr. |
| 5,836,553 | A | 11/1998 | Bergaila |
| 5,842,595 | A | 12/1998 | Williams |

(Continued)

*Primary Examiner*—Ramon O Ramirez
(74) *Attorney, Agent, or Firm*—Lane Patents LLC

(57) ABSTRACT

The present invention is a lightweight portable foldable bag holder that can be carried by hand or mounted in a number of locations. It can be used in a number of horizontal or vertical positions varying between in an open or a closed position. The closed position being best suited for storage or transport with an attached bag. Uses include but are not limited to holding trash, recycling such as; crushed cans, plastic, paper, lawn and garden debris, outdoor uses include yet are not limited to concerts, athletic events, outdoor restaurants, on decks, on boats, recreational vehicles, picnics, in parks. The invention is suited for all types of flexible bags, and can be mounted in one location, or moved to another using handle and semi-permanently attached with a nail or new screws or temporarily attached to a pole or a tree using a cord or rope as supplied.

11 Claims, 4 Drawing Sheets

U.S. PATENT DOCUMENTS

| | | | | |
|---|---|---|---|---|
| 5,871,037 | A | 2/1999 | Feldt | |
| 5,884,454 | A | 3/1999 | Steinmetz | |
| 5,947,602 | A | 9/1999 | Coxsey | |
| 6,003,820 | A | 12/1999 | Baldonado et al. | |
| 6,089,514 | A | 7/2000 | Huang et al. | |
| 6,131,861 | A | 10/2000 | Fortier, Jr. et al. | |
| 6,155,521 | A | 12/2000 | O Hanlon | |
| 6,155,522 | A | 12/2000 | Anderson | |
| 6,199,802 | B1 | 3/2001 | Scheibe, Sr. | |
| 6,315,143 | B1 | 11/2001 | Dotts | |
| 6,431,503 | B1 | 8/2002 | Horan | |
| 6,446,919 | B1 | 9/2002 | Tsui | |
| 6,994,302 | B1 | 2/2006 | Simmons | |
| 7,175,139 | B2 | 2/2007 | Broeders | |
| 7,222,825 | B2 | 5/2007 | Gilbert | |
| 7,237,753 | B2 | 7/2007 | Metcalfe | |
| 2009/0230258 | A1* | 9/2009 | McFadden | 248/101 |
| 2010/0018102 | A1* | 1/2010 | Minges | 42/94 |

* cited by examiner

PORTABLE FOLDABLE MULTI-PURPOSE FLEXIBLE BAG HOLDER

RELATED APPLICATIONS

The present application is a continuation-in-part application under 35 USC §120 of U.S. Utility patent application, Ser. No. 11/827,874; filed 13 Jul. 2007, now abandoned, included by reference herein and for which benefit of the priority date is hereby claimed.

FIELD OF THE INVENTION

The present invention relates to a refuse bag rack to hold a garbage bag for collecting garbage and, more particularly, to a multipurpose bag holder with means to support bags in an open position to receive articles, which is portable and can be collapsed for easier transport, or to fit with the rim flush with a wall or other surface.

BACKGROUND OF THE INVENTION

Refuse bags and holders have been known for some time in the prior art. Typically, the design is intended to be kept in one stationary location with a plastic bag of one size or another being held in an open position for ease of refuse disposal.

U.S. Pat. No. 1,351,094; issued Aug. 31, 1920 as a mounted sack holder is not portable and provides use with only one type of sack or bag.

U.S. Pat. No. 4,312,489; issued Jan. 26, 1982 as a bag holder for collapsible bags. This holder uses a support pole only which sticks into the ground and does not have provision for a cover or provide for a means of sealing the contents of the bag from the elements.

U.S. Pat. No. 5,738,315; issued Apr. 14, 1998 as a portable holder for a refuse bag having a sled portion on the bottom for dragging across the ground by road crews etc.

U.S. Pat. No. 5,836,553; issued Nov. 17, 1998 as a device for holding bags with a support ring and clam shell like clamping mechanism. It can be folded away to close the bag shut, however this is not portable and cannot be hand held.

U.S. Pat. No. 5,947,602; issued Sep. 7, 1999 as a portable trash-carrying device with a main objective of and arm for allowing the plastic bag to be held off the ground with a secondary bag of heavier weight to keep the plastic from splitting open. The current invention does not provide for mounting on an existing surface, or for covering with a top or multiple utility.

U.S. Pat. No. 7,175,139; issued Feb. 13, 2007 as a bag holder made of a wire frame for holding a bag in an upright and open position is mountable, typically in the inside door of a kitchen cabinet. It can have a top, yet not portable or usable or adaptable to a hand held operation.

U.S. Pat. No. 7,237,753; issued Jul. 3, 2007 is directed toward a debris collecting bag and bag holder having a sleeve which drops down into the bag and forms a trap door which prohibits the refuse from coming back up through the top allows the apparatus to be folded and manually operated, however it is not mountable nor does the folding close the bag.

The need exists for a multipurpose, portable bag holder having both a handle and means for mounting in a stationary position as desired. Means for mounting the holder may include wood or metal screws, nails, pegs and the like. Further a ropelike attachment, which may take the form of a cord, bungee cord, rope, strap, or the like is provided to mount the holder in a temporary fashion to a tree, post, pole or similar implement.

The bag holder can also be retracted, as desired, in such a way as to fit flush with a wall or other surface. Further, in this retracted position, the contents are secured and kept protected from wasps, bees, or other insects. In addition, the apparatus is easier to transport in the retracted position. When desired, the holder can be restored to its operational position.

SUMMARY OF THE INVENTION

The current invention, comprises a handle for ease of carrying with several means for mounting, either permanently or temporarily, to a wall or post as needed. Previous inventions from 1918 and until now have attempted to secure a bag to various hoops and stands, yet has not allowed the bag holder to be portable and therefore have multi-purpose utility. They either are mountable or portable, not both in one invention.

A bag holder that is portable, foldable and multi-purpose for holding a flexible bag in an open position. This mountable or hand held bag holder eliminates the need for a bulky container. This plastic molded lightweight bag holder, which supports a flexible plastic bag allowing cans, bottles, other recyclables, laundry, trash, grass clippings, or other debris to be easily directed into the bag. The bag holder top piece can then be folded to close the top of the bag.

Utilizing two mounting screws the bag holder can be hung in almost any location throughout the home, garage, deck, yard, picnic area, park, on a boat, recreational vehicle, or other outdoor location. The screws, wood or metal type can be attached appropriately loose to allow the bag holder to be lifted off the mount and moved to another location with the carrying handle.

The mounting bracket allows for various locations and the bag holder handle makes moving and set up operations easy. An operator simply needs to lift the bag holder off the screws and it can be comfortably carried to a new location. The bag holder could be mounted and used for cans in the garage and then attached to a stake or easily carried about by a person who is picking up and bagging either garbage or lawn and garden debris.

This bag holder is compact and bag sizes from small kitchen bags to large construction bags fit this holder. The bag holder and flexible bags allow for small space use by not needing a bulky container. For example, in a closet used for recycling, you can fit three bag holders in the same space needed for one bulky container that would hold a 33-gallon flexible bag.

BRIEF DESCRIPTION OF THE DRAWINGS

A complete understanding of the present invention may be obtained by reference to the accompanying drawings, when considered in conjunction with the subsequent, detailed description, in which.

REFERENCE NUMERALS IN DRAWINGS

10—base
12—handle
14—eyelet
16—fastening slot
20—trash bag
22—race
24—receptacle
26—holder
27—retainer
28—elongated flexible member
30—structure
32—ledge portion
34—bolt hole
34*a*—oblong bolt hole
36—bolt
38—nib receptacle
40—orifice
42—lower rim
44—shoulder
46—rotation stop
48—bolt retainer
52—cleat
54—latch receptacle
60—upper orifice
62—upper rim
64—attach point
68—hinge
72—cleat receptacle
74—latch
76—nib
102—handle
103—vertical member
104—eyelet
105—shelf
106—fastener
108—first retainer
110—second retainer
112—first ledge
114—second ledge
116—third ledge
118—forth ledge
119—fifth ledge
120—ring stabilizer
122—ring attachment

DESCRIPTION OF THE INVENTION EMBODIMENTS

Figure 1:
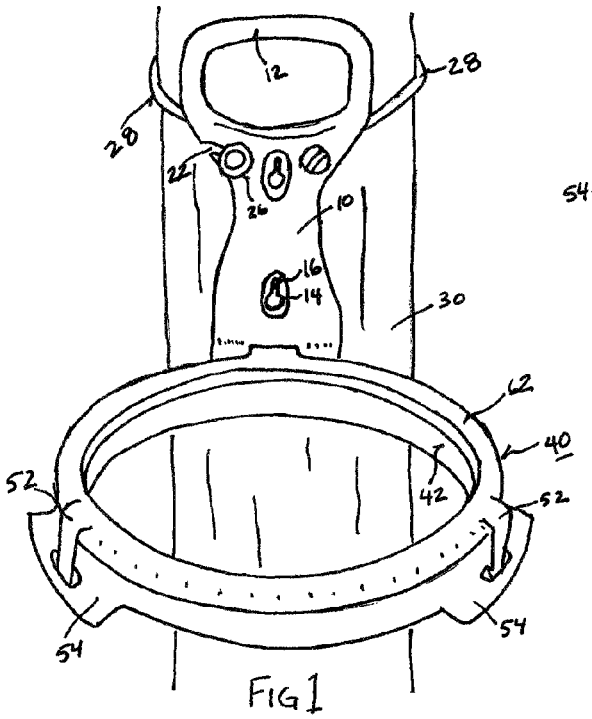
FIG. 1 depicts a front perspective view of a bag holder in an open position.
Figure 2:
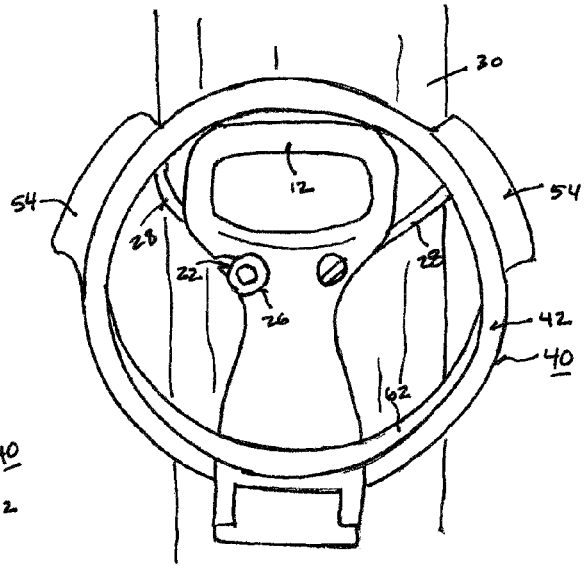
FIG. 2 depicts a front perspective view of a bag holder in a closed position.
Figure 3:
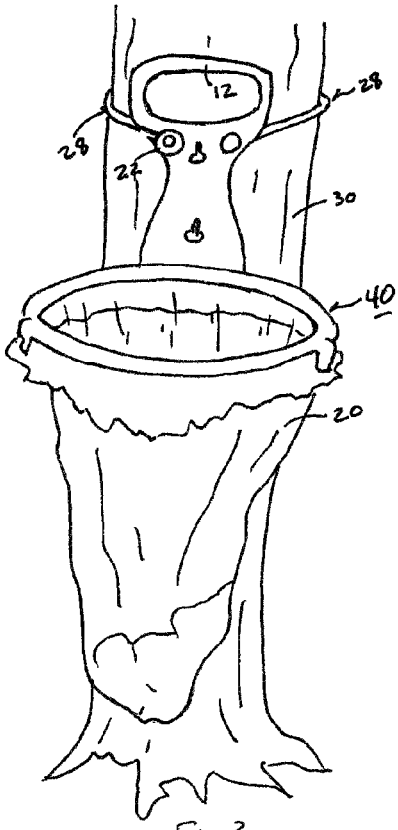
FIG. 3 depicts a front perspective view of a bag holder with a bag in an open position.

A preferred embodiment, as shown in FIGS. 1-4, show the Bagalot™ multipurpose flexible bag holder in a primary position for use. In this case the base 10 is mounted to a structure 30 such as tree or wooden pole or the like by means of an elongate flexible member 28. An elongate flexible member 28 can be a rope, elastic cord, bungee cord, wire or the like to secure the base 10 to the structure. Additionally, a fastener such as a screw, nail or the like can be attached via the eyelet 14 and 16 fastening slot such that it can be semi-permanently affixed to a structure. FIGS. 1 and 3 show the orifice 40, generally comprised of an upper rim 62 and a lower rim 42, in an approximately horizontal position for depositing articles of refuse, generally in a trash bag as shown in FIG. 3. The trash bag is held in place by means of a cleat 52 and latch receptacle 54 in this case. Those skilled in the art will recognize various alternative ways to hold a trash bag between a plurality of rims. The Bagalot™ multipurpose flexible bag holder is preferred to be manufactured of a rigid plastic molded by a machine process, or equivalent.

Figure 4:
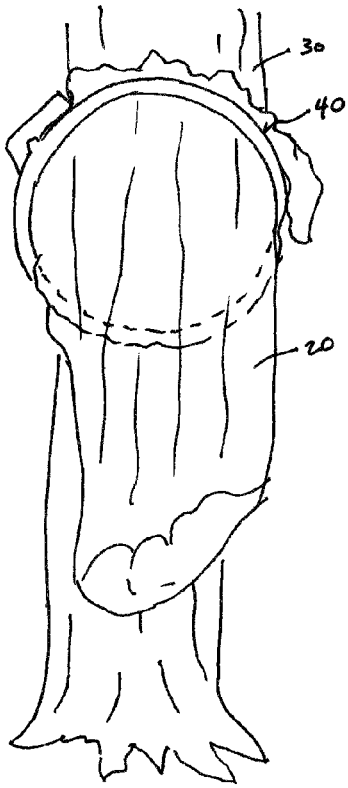
FIG. 4 depicts a front perspective view of a bag holder with a bag in a close position.

FIGS. 2 and 4 show the orifice 40 retracted to an approximately vertical position to minimize the footprint. This is particularly valuable when space is tight, or as shown in FIG. 4, to allow the trash bag 20 to fold back on itself to quasi seal the contents of the bag 20.

Figure 5:
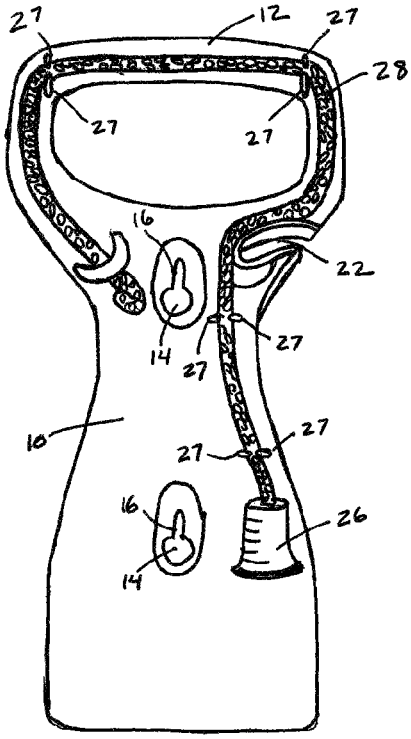
FIG. 5 depicts a back plan view of a handle and vertical member with an elongated flexible member.

FIG. 5 shows a means for integrating the elongated flexible member 28 into the base 10 for storage by means of a series of retainers 27.

Figure 6A:
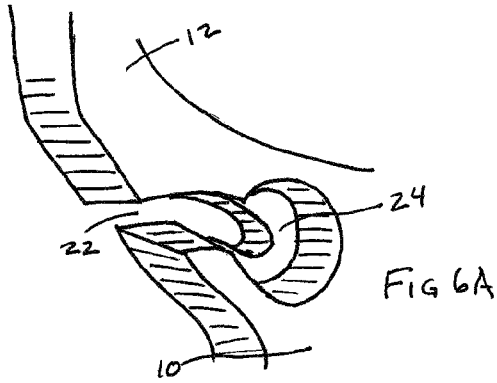
FIG. 6A through 6C depicts a perspective view of an elongated flexible member having a retainer latching with a receptacle.
Figure 6B:
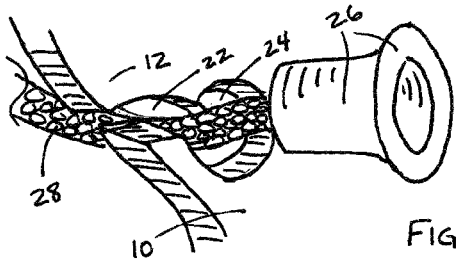
Figure 6C:
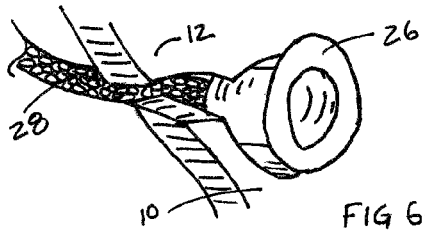

In use, the elongate flexible member 28 can be removed from the retainers 27, generally by pulling the holder, placing the base 10 adjacent to a structure 30 (not shown), and encircling the elongate flexible member 28 around the structure 30, and through the race 22 such that the holder 26 is secured to the receptacle 24 as shown in FIGS. 6A, 6B, and 6C. Generally the elongate flexible member 28 is preferred to be an elastic cord to create tension on the member 28 thus holding the base 10 tight against the structure 30.

Figure 7:
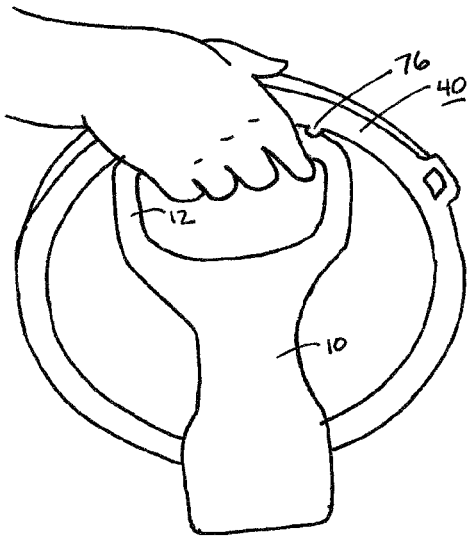
FIG. 7 depicts a perspective view holder in a closed position being carried.
Figure 8:
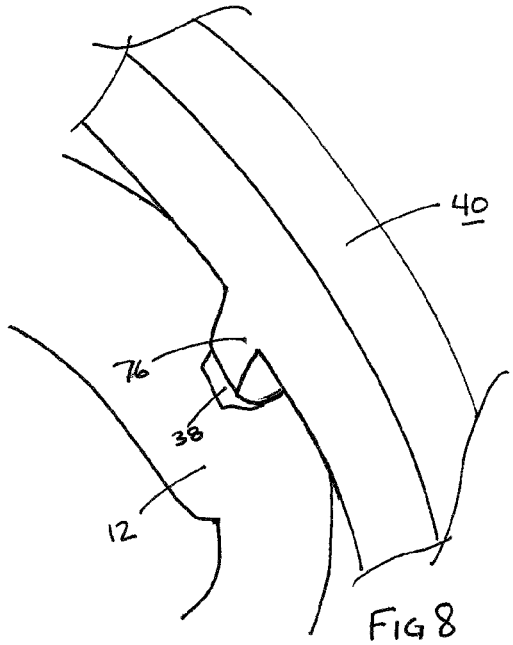
FIG. 8 depicts a close-up perspective view of a portion of a rim having a nib which is engaged with a nib.

FIGS. 7 and 8 show a means for holding the orifice 40 in a position approximately parallel with the base 10 for ease of transport. A handle 12 is included to facilitate transport. A soft-latch mechanism comprising a nib 76 which can also be a tooth, protrusion, lip, flange, projection or the like is coupled with a nib receptacle, which can be an indentation, notch, groove, dimple, pock or the like is arranged to form a catch. The soft-latch mechanism facilitates ease of transport, as shown in FIG. 7. It also facilitates the holding of the orifice 40 in a retracted position for minimal footprint, as shown in FIG. 4.

Figure 9:
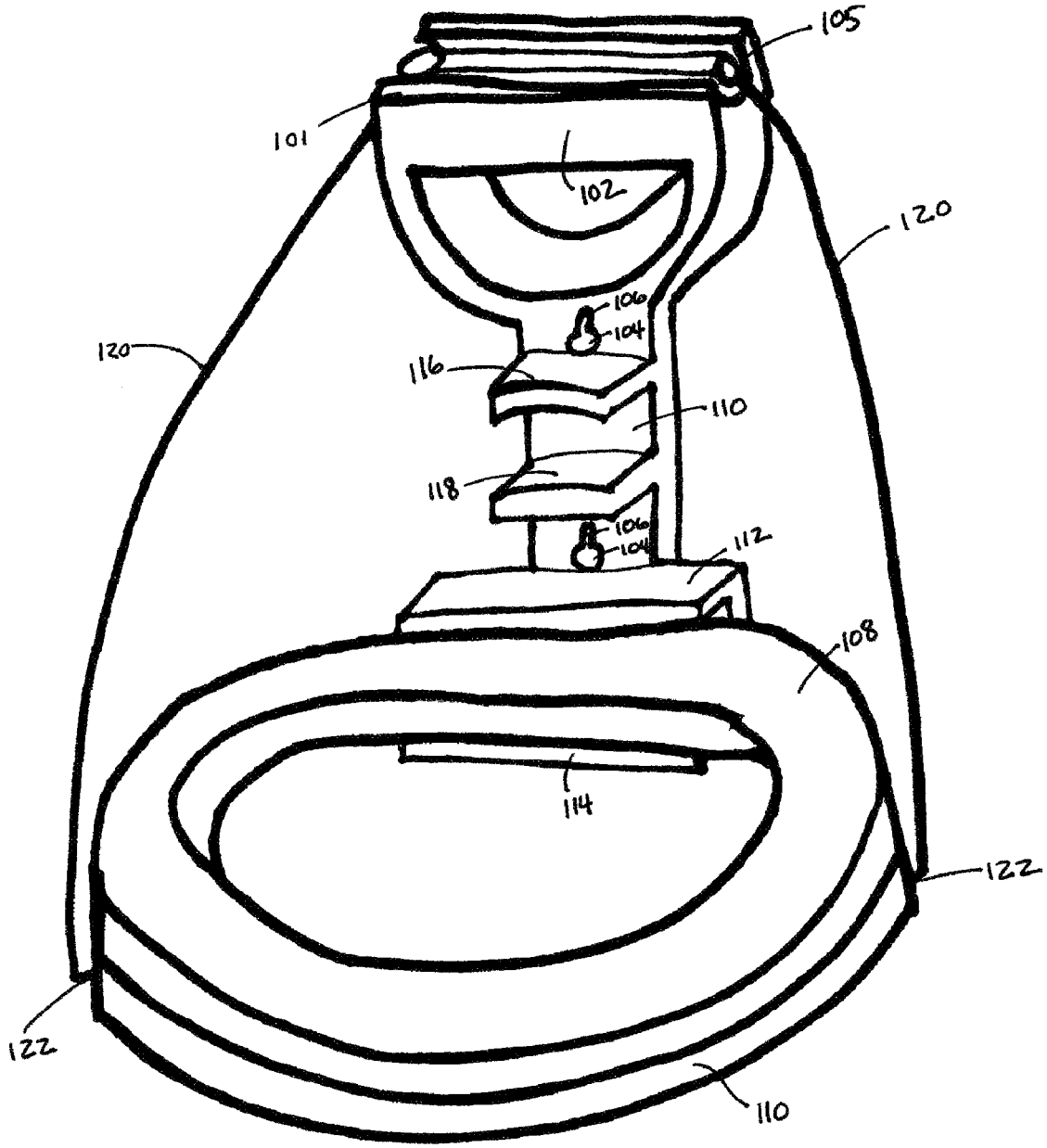
FIG. 9 depicts a perspective view of an alternate embodiment of a bag holder.

FIG. 9 shows an alternate embodiment of the present invention. A handle 102, for ease of transport, and having a shelf 105 is attached to a vertical member 103 of sufficient dimensions and material to support a series of ledges 112, 114, 116, and 118. The shelf 105 is preferred to have a holding member such as a lip 101, or equivalent structure, for holding the ring stabilizer 120. The ring stabilizer in turn is connected through a several ring attachments 122 with a bag retaining means, preferably comprised of a first retainer 108 and a second retainer 110. The ring attachment should be placed such that the load is balanced, but can be at a wide variety of locations along the circumference of the retainers 108, and 110. In the present example, the ring attachment is located midway between the back and front edges.

Figure 10A:
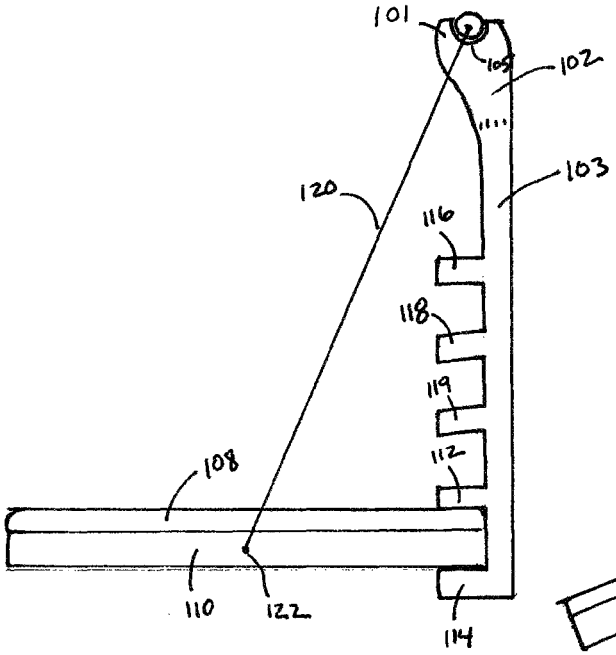
FIGS. 10A through 10C depict a side view an alternate embodiment of a bag holder having the rim set in a multitude of positions.
Figure 10B:
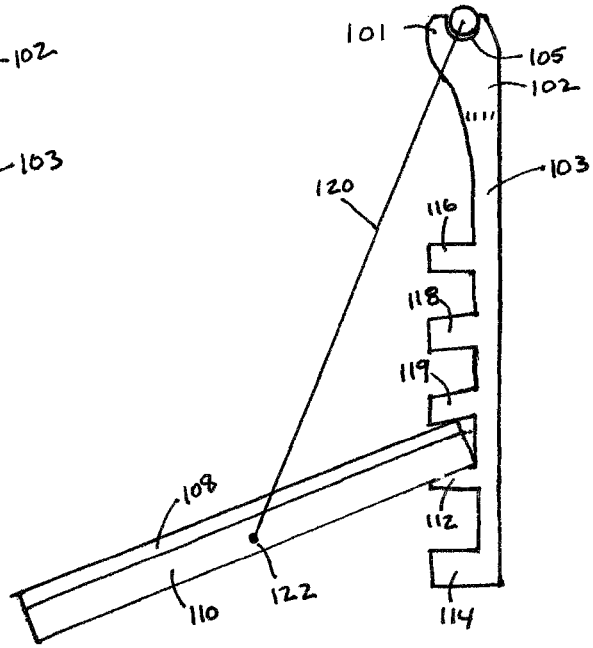
Figure 10C:
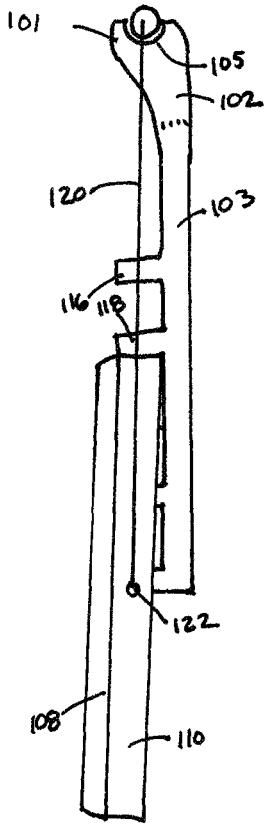

The ledges, 112, 114, 116, 118, and 119 in the embodiment shown in FIGS. 10A, 10B, and 10C; are spaced such that the proximal end of the retainers 108, 110 be press fit between them forming a plurality of possible arrangements. The present embodiment allows a plurality of rim positions for the convenience and amusement of the user.

CONCLUSION, RAMIFICATIONS, AND SCOPE

Although the present invention has been described in detail, those skilled in the art will understand that various changes, substitutions, and alterations herein may be made without departing from the spirit and scope of the invention in its broadest form. The invention is not considered limited to the example chosen for purposes of disclosure, and covers all changes and modifications which do not constitute departures from the true spirit and scope of this invention.

Having thus described the invention, what is desired to be protected by Letters Patent is presented in the subsequent appended claims.

What is claimed is:

1. A portable foldable multipurpose flexible bag holder for portable use, comprising:

(i) a plurality of rings for holding a bag;

(ii) an elongated member;

(iii) a handle portion being connected with, and situated substantially above, the rings; said handle portion comprising a vertical member having a front face and a back face, the back face being fitted with a plurality of retainers at predetermined positions; the retainers being suited to receive said elongated flexible member, (iv) the vertical member further having a race terminating at an outward edge of the vertical member and originating interior to the vertical member;

(v) said elongated member having an originating end and a terminal end, with the originating end being securely fastened to the vertical member, and the terminal end being detachably connected with the vertical member and, (vi) a receptacle being associated with the race for receiving the retainer.

2. The bag holder in accordance with claim 1 having a soft latch mechanism further comprising;

(i) the rings further comprising an orifice (ii) a hinge between the handle portion and the rings, (iii) at least one nib receptacle substantially near the top of the handle portion, (iv) at least one nib located along the inner perimeter of the orifice, such that when the rings are positioned substantially along the plane defined by the vertical member, the nib forms a holding connection with the nib receptacle, retracting the orifice to an approximately vertical position.

3. The bag holder in accordance with claim 2 wherein having the orifice in an approximately vertical position allows a trash bag to fold back on itself forming a quasi seal of the contents of the bag.

4. The bag holder in accordance with claim 3 wherein the soft latch mechanism facilitates ease of transport.

5. The bag holder in accordance with claim 3 wherein the soft latch mechanism holds the orifice in a retracted position thus providing a minimal footprint.

6. The bag holder in accordance with claim 5 wherein the upper rim further comprises a cleat and the lower rim further comprises a latch receptacle being detachably connected with the cleat.

7. The bag holder in accordance with claim 1 wherein the vertical member further comprises an eyelet and a fastening slot for attaching the bag holder to a structure.

8. The bag holder in accordance with claim 1 further having the elongated flexible member being an elastic rope.

9. The bag holder in accordance with claim 8 wherein the elastic rope is integrated into the back face of the handle portion for storage.

10. The bag holder in accordance with claim 1 further comprising a lid for covering the plurality of rings for holding a bag.

11. The bag holder in accordance with claim 1 wherein the plurality of rings further comprises an upper rim in association with a lower rim.

* * * * *